United States Patent [19]

Airaudo

[11] 4,020,909

[45] May 3, 1977

[54] PORTABLE EARTH DRILLING APPARATUS

[76] Inventor: Antonin Airaudo, 5, boulevard Notre-Dame, 13006 Marseille, France

[22] Filed: Nov. 26, 1975

[21] Appl. No.: 635,705

[30] Foreign Application Priority Data

Nov. 26, 1974 France ..... 74.41057

[52] U.S. Cl. ..... 173/147; 173/28; 173/57

[51] Int. Cl.[2] ..... E21C 11/02

[58] Field of Search ..... 173/28, 32, 57, 147, 173/160, 152; 52/118; 308/6 R

[56] References Cited

UNITED STATES PATENTS

| | | | |
|---|---|---|---|
| 2,508,835 | 5/1950 | Moon et al. | 51/118 X |
| 3,162,253 | 12/1964 | Curtis | 173/147 |
| 3,756,670 | 9/1973 | Harris | 173/32 X |

FOREIGN PATENTS OR APPLICATIONS

| | | | |
|---|---|---|---|
| 290,322 | 5/1967 | Australia | 173/147 |
| 355,753 | 8/1957 | Switzerland | 173/28 |

*Primary Examiner*—Ernest R. Purser

[57] ABSTRACT

Earth drilling apparatus comprising an extensible mast constituted by a fixed lower ramp and an upper slide mounted with capability of longitudinal sliding on the fixed ramp. A rotation head for driving a drill string is movable on and guided over the length of the slide and the movements of extension and retraction of the slide are synchronized with ascending and descending displacements respectively of the rotation head. For this purpose two double-acting jacks connect the lower portion of the fixed ramp to the upper portion of the movable slide and each of a first pair of chains is wound on one pulley mounted on the upper extremity of each of the posts of the movable slide and is fixed at one of its extremities to the rotation head and at the other of its extremities to a cross-brace rigidly connecting the upper extremity of the posts of the fixed ramp. Each of a second pair of chains is wound on a pulley mounted at the lower extremity of each of the posts of the movable slide and is fixed at one of its extremities to the rotation head and at the other of its extremities to the cross brace. The axes of said jacks and the axes of said pulleys are disposed in a common plane.

16 Claims, 13 Drawing Figures

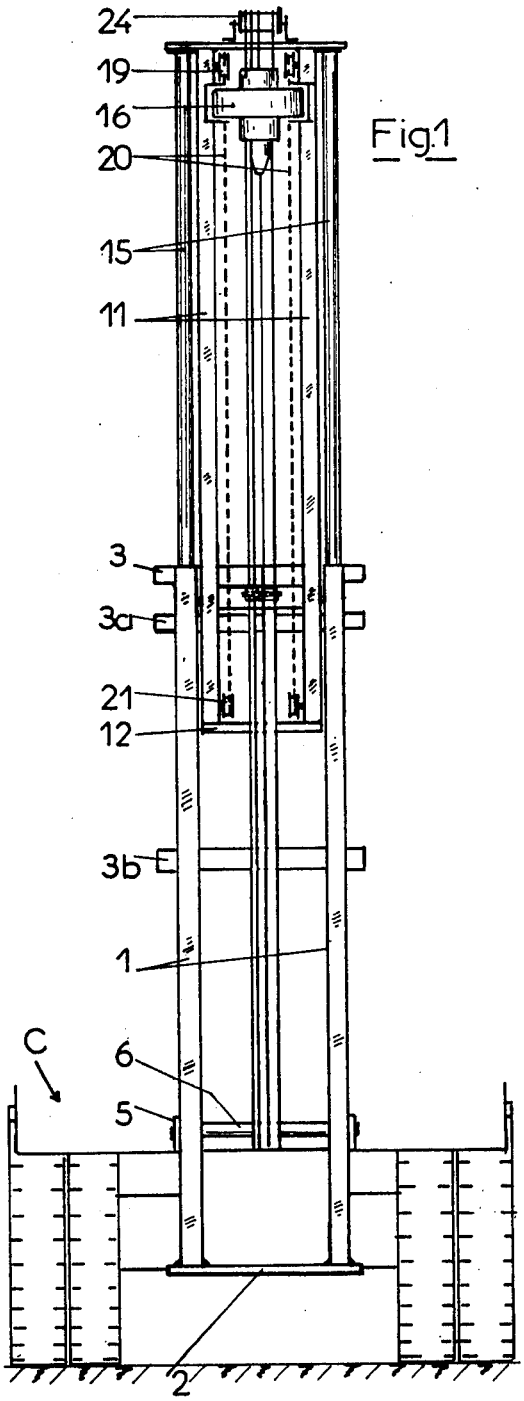
Fig.1
Fig.2
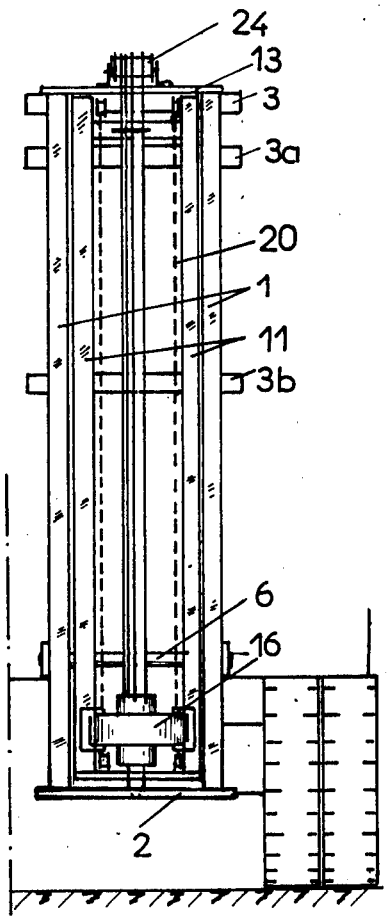

Fig.6
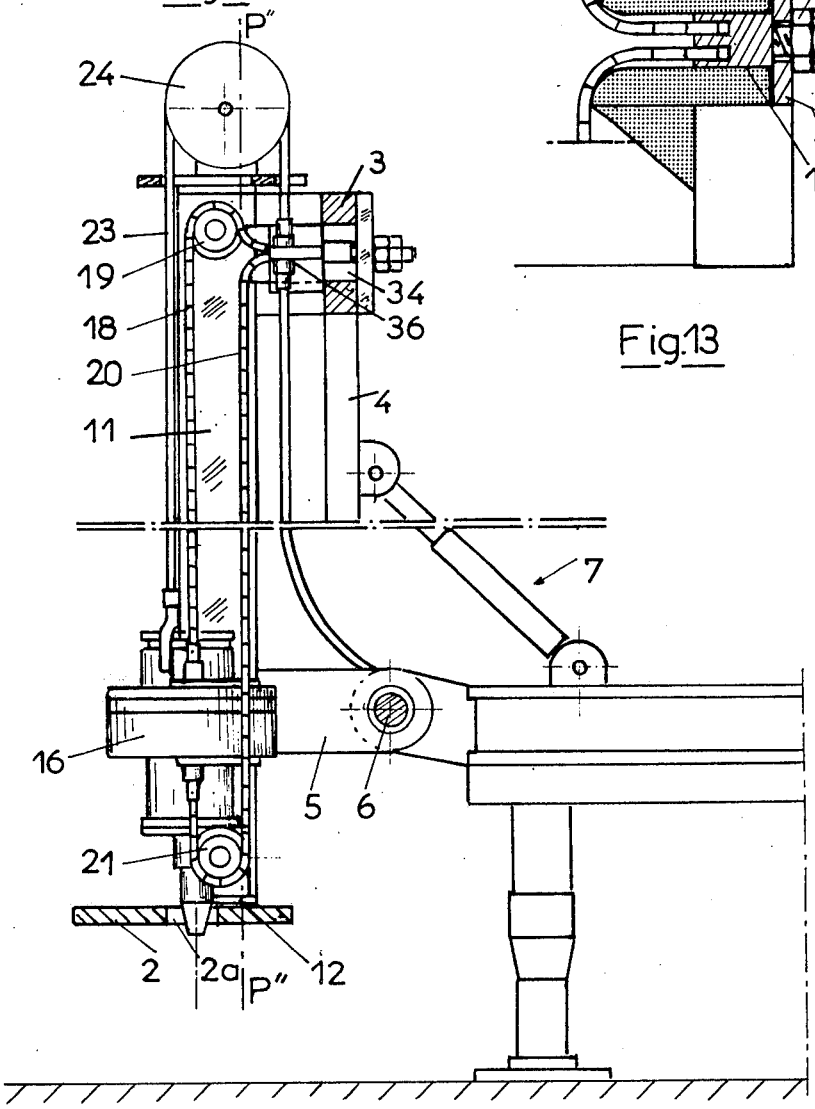
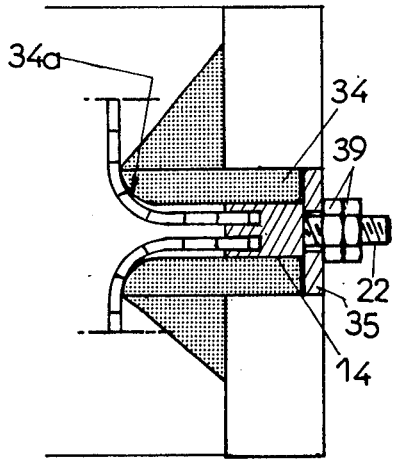
Fig.13

PORTABLE EARTH DRILLING APPARATUS

FIELD OF THE INVENTION

The present invention relates to drilling apparatus with an extensible mast particularly for effective drilling or boring operations to great depths by means of a drill string of shafts assembled in succession and at the lower extremity of which is mounted the tool for drilling such as a bit, a hammer, etc.

BACKGROUND

Drilling apparatus is known comprising an extensible mast constituted of a fixed ramp on which is slidably mounted, by means of lateral double-action jacks or cylinders, a movable slide over the length of which the drilling head is guided to drive the tool. Means are provided for synchronization of the raising and lowering movements of the drilling head with those of the movable slide. Such means include a first pair of chains each of which is wound on a wheel or pulley mounted at the upper part of the movable slide and is fixed at one of its extremities to the drilling head and at the other of its extremities to the upper portion of the fixed ramp, and a second pair of chains, each of which is wound on a wheel or pulley mounted at the lower portion of the movable slide and is fixed at one of its extremities to the drilling head and at the other of its extremities to the upper portion of the fixed ramp. Such machines have been developed for drilling bores for mining exploitation and are adapted to the formation of holes of relatively small diameter at small depths of the order of several meters for placement of explosive charges in the holes for producing shock waves in the ground.

Such machines are totally inapplicable for drilling or boring to great depths for which they have not been studied.

In fact, the double-action cylinders connecting the fixed and movable portions of the masts are disposed on each side of the said portions and thereby cannot resist the substantial forces of raising a drill string or the still more considerable forces resulting from a jamming of the string which would produce a buckling of the cylinders to put them out of service. In addition, the cylinders are fixed at a distance from the base of the fixed ramp whereas the flexible feed lines for the drilling head bear on a drum disposed at a distance from the top of the movable slide and at the interior of this latter such that the useful travel of the drilling head is about 0.880 with respect to the length of the fixed ramp which represents a small gain in comparison with the possibilities offered for a conventional non-extensible mast and therefore only permits utilization of elements of reduced length for the constitution of the drill string. In addition, the misalignment of the length of the return chains of the drilling head and of the axis of the latter, on the other hand, and the axes of the cylinders and the pulleys or the wheels on which the chains are wound, on the other hand, as well as the offset of the load and resistance axes prevent the utilization of such machine for the execution of deep drilling. In addition, the accelerated wear of the contact surfaces resulting from the deficient mode of displacement of the movable parts of the machine, the misalignment of the axes of the drive elements and the axes of the movable portions produces a poor guiding of the drilling string resulting in jamming and rapid destruction of the costly connection means of the elements or elongation of the drill string.

The disasterous effects of these misalignments are amplified by the absence of means for regulating the tension of the chains in a possible application of this machine for deep drilling.

Furthermore, the slidable mounting of the lateral profile of the movable slide on the sides of the fixed advance ramp produces substantial friction at these surfaces thus creating strong resistance to the sliding of the slide while accelerating the wear of the surfaces between which can be encrusted abrasive impurities in the course of operation.

Additionally, the above-mentioned machine is provided with flexible feed conduits bearing on a drum mounted in the interior of the movable slide and carried by the axle supporting the pulleys on which the chains are wound at a distance from the extremity of the slide, which has as a consequence, reduction of the path of travel of the drill head while producing suspended loops at the time of retraction movement of the masts, these loops resulting in damage of the conduits and interference with the working operations.

SUMMARY OF THE INVENTION

An object of the invention is to provide drilling apparatus having an extensible mast particularly adapted to the formation of deep holes of relatively substantial diameters.

Another object of the invention is to provide drilling apparatus whose rotation head has the greatest possible travel to permit the utilization of shafts or relatively great length for the constitution of the drill string.

Another object of the invention is to provide drilling apparatus which is strong and capable of resisting substantial forces, both at the time of lowering and raising of the drill string, while being perfectly free from the factors causing self-deterioration or of accelerated wear of the different portions or of the members constituting the drill string.

Another object of the invention is to provide drilling apparatus comprising an arrangement of flexible feed conduits which do not form any suspended loop at the time of the lowering movements of the rotation head and of the mobile slide while permitting a maximum path of travel of the rotation head in its upper position.

The drilling machine according to the invention comprises a ramp or lower fixed portion, a slide or upper movable portion sliding parallel on the fixed lower portion, a rotation head or drive means for the drill string guided for slidable movement over the length of said slide, means for effecting raising and lowering of the upper movable portion, while at the same time producing ascending and descending displacement of the rotation head, said means comprising two double-acting jacks mounted at the interior of posts of the fixed ramp and connecting the rotation table or drilling table constituting the base of said fixed ramp of the mast to the top of the movable slide of the said mast.

According to a characteristic feature of the invention, the means for producing the synchronized displacement of the rotation head with respect to the movable slide of the mast comprises a first pair of chains each of which is wound on a pulley mounted at the upper extremity of each of the posts of the movable slide and is fixed at one of its extremities to the rotation head and at its other extremity to a cross-brace rigidly connecting the upper extremity of the posts of the fixed ramp of the said mast, and a second pair of chains each of which is wound on pulley mounted at the lower extremity of each of the posts of the said movable slide and is fixed at one of its extremities to the said cross brace, the axes of the jacks and the axes of the said pulleys being disposed in the same plane.

The length of the chain connecting the rotation head to the pulley is disposed in the same plane as the longitudinal axis of the said rotation head.

According to a further characteristic of the invention, the machine comprises means for regulating the tension in the chains.

According to another characteristic feature, the slidable mounting of the movable slide is obtained, on the one hand, by means of pivotable rollers mounted at its lower extremity and rolling on the said movable slide.

According to another characteristic feature, the flexible conduits connected to the rotation head each comprises a section connected at one of its extremities to the rotation head and at the other of its extremities to a cross brace connecting the posts of the fixed ramp of the mast, said conduits bearing on a member carried at the upper portion of the movable slide of the said mast.

According to another characteristic feature, the bearing member of the flexible conduits is disposed externally of a plate rigidly connecting the posts of the upper movable slide of the mast.

These characteristic features and still others will appear in greater detail from the description which follows and from the annexed drawings.

BRIEF DESCRIPTION OF THE DRAWING

FIG. 1 is a simplified front view of a drilling machine mounted at the rear of a truck and whose extensible mast is shown in maximum position of extension.

FIG. 2 is a view similar to FIG. 1 in which the mast is shown in its retracted or telescoped state.

FIG. 6 is a sectional taken on line 6—6 of FIG. 5.

FIG. 13 is a detailed view in longitudinal section showing one embodiment of means for regulating the tension of the chains.

DETAILED DESCRIPTION

Figure 3:
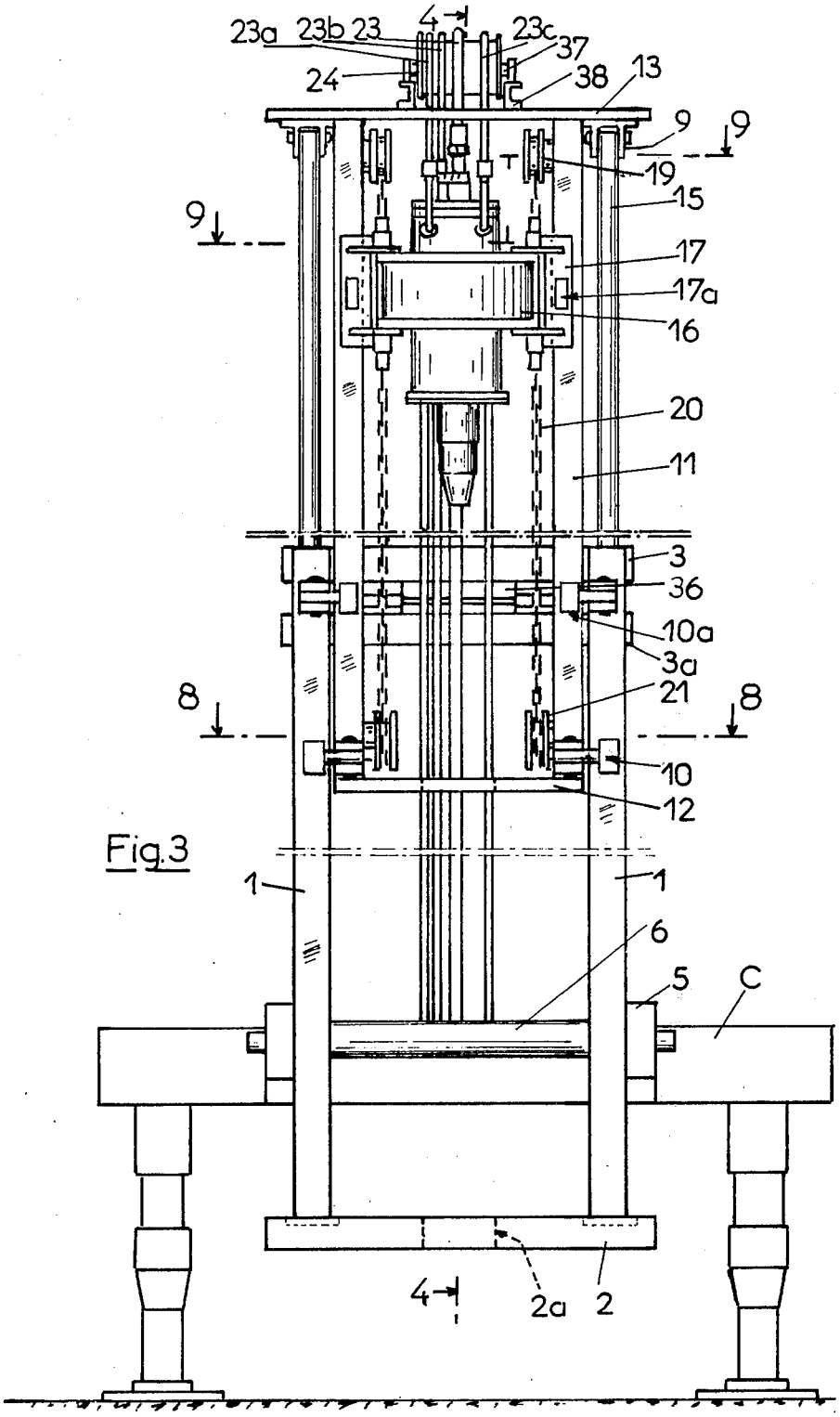
FIG. 3 is a front view on greater scale corresponding to FIG. 1.

Reference will be made to the drawings to describe an advantageous embodiment of apparatus for drilling or boring holes in the ground according to the invention which in this case is mounted in effective manner at the rear of the truck but which is also capable of being disposed or carried by any other platform or displaceable framework.

It is also not excluded to employ the means of the invention in fixed installations.

The apparatus of the invention is especially adapted to the execution of drilling or boring to great depths and which can operate in a vertical or inclined position. For this reason, there are employed hereafter expressions such as "lower portion", "upper portion", "posts", "base", "summit", etc. . . . . It is nevertheless obvious that these are not limiting expressions as the arrangement according to the invention is workable in a horizontal plane as will be easily understood.

The apparatus of the invention comprises an extensible mast or tower composed of at least two parts, namely a ramp or lower fixed part, and a slide or upper movable part slidably mounted on the lower part.

According to one embodiment, the lower and upper parts are each constituted of two parallel elements suitably connected together.

Thus, the lower portion comprises two posts 1 formed as metal beams of quadrilateral section, for example, rectangular, whose base is fixed by welding or the like to a rotation table or drilling table 2 which serves to connect the lower ends of the posts. The drilling table 2 is provided, in conventional manner, with an aperture 2*a* for the passage and the centering of the drill string or of the drill (not shown), and with flexible feeders (not illustrated) generally suspended at the edges to intercept the projection of powder or mud.

The posts 1 are also rigidly connected by an upper cross brace 3 and by one or more intermediate cross braces 3*a*–3*b*, etc . . . . according to the height of the posts. The cross braces 3—3*a*–3*b* are disposed on the rear side of the mast and advantageously have no projecting portions so as not to interfere with displacement of the upper portion of the mast and of the rotation head. The cross braces are preferably connected by lateral arms 4 extending parallel to the posts 1. In the region of the base, each post 1 has a fixed flange 5 permitting pivotal mounting of the mast on an axle 6 secured to the chassis C of a truck or any other platform or rolling framework capable of being towed or otherwise displaced.

One or more jacks or cylinders 7 connect the chassis C to the arms 4 to permit placement of the mast in any desired angular position between vertical and horizontal depending on the direction of the holes to be drilled. The drawings illustrate a vertical position of the mast which, of course, is not limiting in scope.

The slide or upper movable portion of the mast is also constituted by two posts advantageously formed by two metal beams 11 of quadrilateral section, preferably rectangular, each of which is mounted with capability of sliding along the length of a respective post 1 of the fixed ramp.

The beams 11 are rigidly cross braced, on the one hand, at their base by a plate 12 having a chamfer at the front for the passage of the drill string and, on the other hand, at their top by a plate 13 of greater size than that of the plate 12, the plate 13 extending laterally beyond the lateral outside faces of the posts 11.

The length of the beams 1 and 11 can be determined as a function of the nature of the work which is intended for the drilling machine and of the length of the elements or of the drill string that one would like to utilize.

The length of the beams 1 and 11 can be substantially equal as is the case in the illustrated embodiment. In this case, the mast has in its retracted position a height limited to that of its lower portion which facilitates the transport of the machine from one location to another while allowing local storage in a place of reduced height during periods of inactivity. Furthermore, it can possess a substantial height, i.e., two times its minimum dimension, when the upper portion is in maximum extension, which permits the utilization of elements of great length for the constitution of the drill string.

Figure 10:
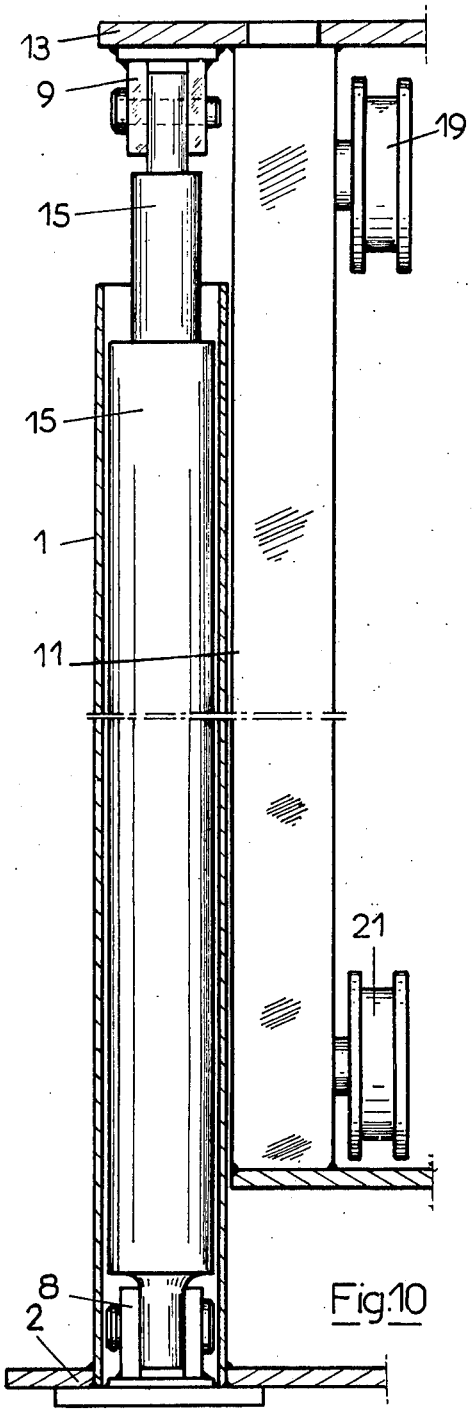
FIG. 10 is a longitudinal section showing the mounting of a jack on a post of the fixed ramp of the mast.

The raising and lowering of the upper portion of the mast or tower are obtained by means of two lateral double-action jacks or cylinders 15 connecting the drilling table 2 constituting the base of the fixed ramp and the plate 13 forming the top of the movable slide. The lower extremity of the jack cylinder is fixed by any conventional attachment means 8 to the drilling table 2 while the upper extremity of the piston rod of the jack is fixed to the plate 13 also by means of any conventional attachment means 9. In addition, and in a particularly beneficial manner, the jacks 15 are mounted in the interior of the posts 1 of the ramp or lower fixed portion of the mast as best seen in FIG. 10. Thereby, there is eliminated all risk of buckling of the jacks at the time of development of substantial force, notably at the time of raising the drill string or in the case of jamming of the drill string.

Furthermore, the attachment positions of the jacks 15 allow a useful path of travel of maximum amplitude of the drive or rotation head 16 from one extremity to the other of the extensible mast as will appear clearly from the following description.

The output obtained by this positioning allows a useful course of travel of the drive comparable to that obtained with conventional masts which are two times as long, hence two times as heavy and two times more cumbersome.

Furthermore, the mounting of the jacks 15 in the interior of the posts 1 of the fixed ramp permits bringing closer together the axes of the forces of the fixed portion with respect to the movable portion.

Figure 8:
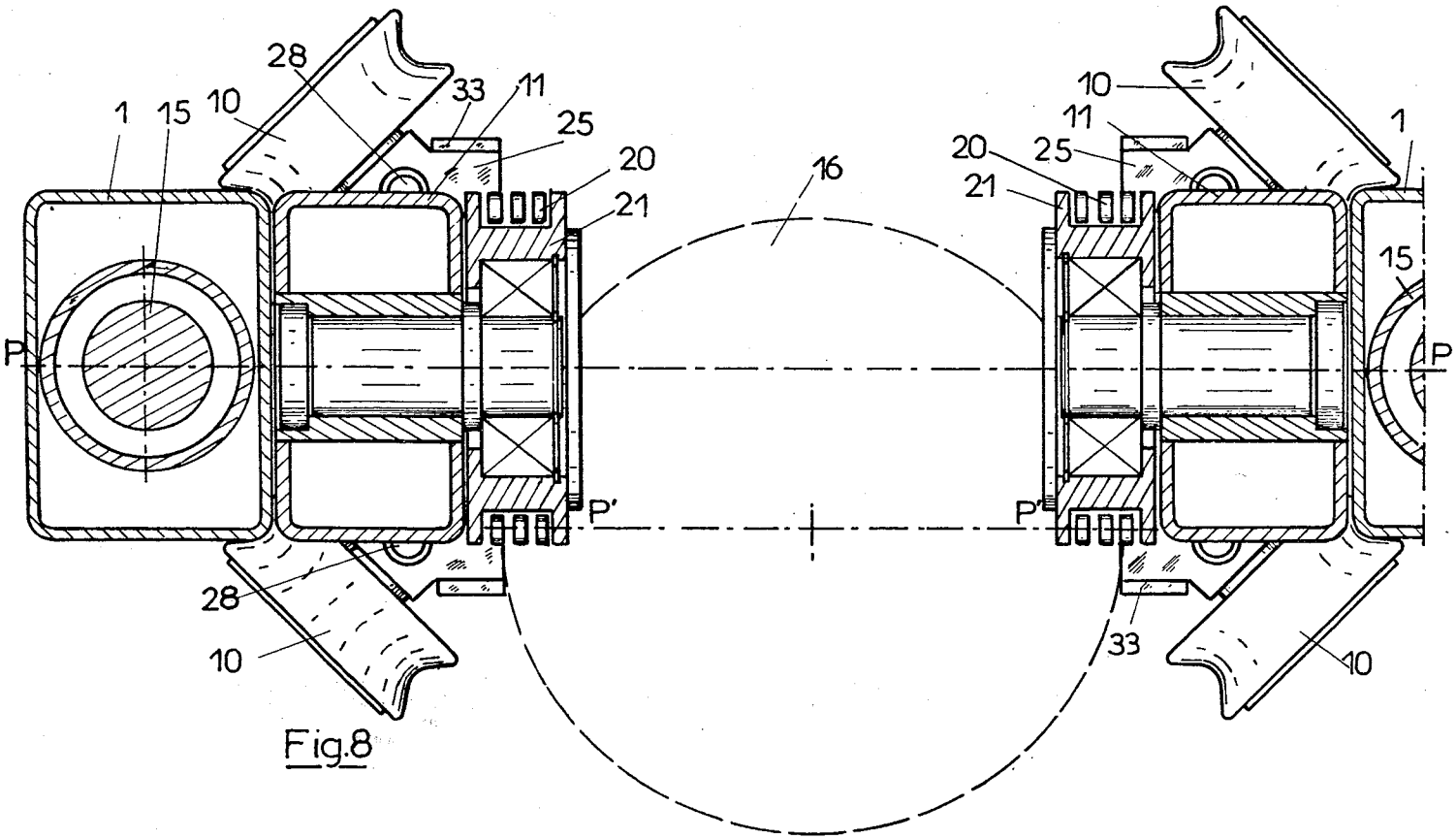
FIG. 8 is a transverse section of the lower portion of the considered machine taken along line 8—8 in FIG. 3, the dotted lines showing the placement of the rotation head.
Figure 9:
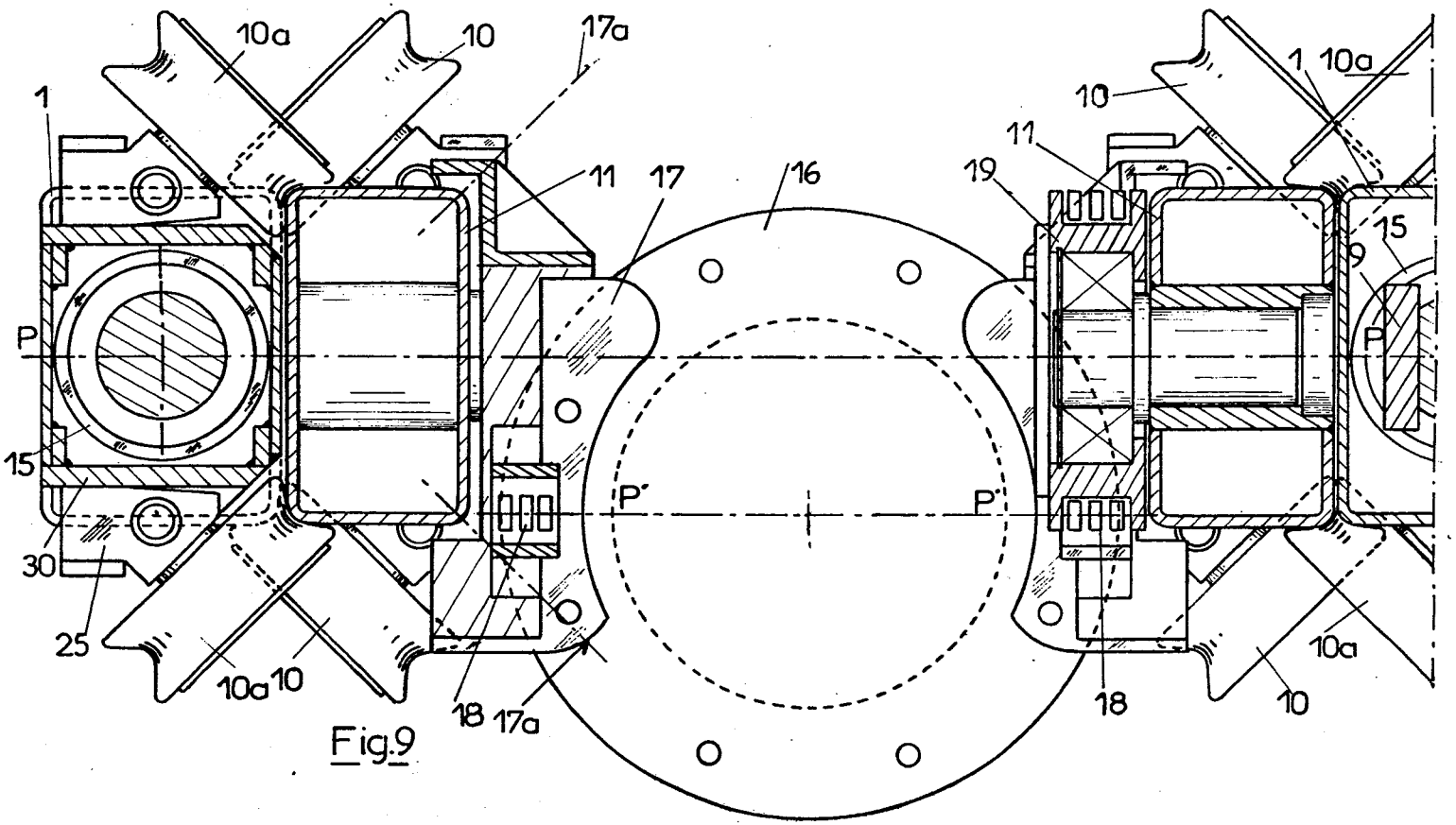
FIG. 9 is a transverse section of the top portion of the machine taken along line 9—9 of FIG. 3.

According to another characteristic arrangement, the sliding mounting of the movable slide is obtained, on the one hand, by means of rollers 10 mounted at its lower extremity and rolling on the fixed ramp and, on the other hand, by rollers **10*a* mounted at the upper extremity of the fixed ramp and rolling on the movable slide, these rollers being shown in schematic manner in FIGS. 3–6 and in more detailed fashion in FIGS. 8 and 9.**

As shown in FIG. 8, roller 10 is grooved and is mounted at an inclination of the order of 45° at the base of each movable post 11 and the rollers travel on opposed internal edges of posts 1 of the fixed portion of the mast. The grooves of the rollers 10 have a complementary profile to that of the rounded edges of the posts 1. In comparable manner, and as shown in FIG. 9, one grooved roller **10*a* is mounted at an inclination of the order of 45° at the upper portion of each fixed post 1 and these rollers roll on opposed external edges of the posts 11** of the movable slide.

In addition, according to the invention, the support shafts of the rollers 10 and **10*a*** are capable of oscillating over a small amplitude.

Figure 11:
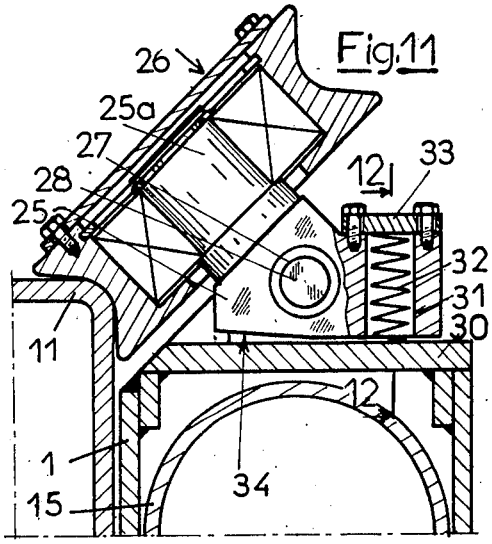
FIG. 11 is a detailed view, partially in section, showing an embodiment of the mounting of oscillating pulleys.
Figure 12:
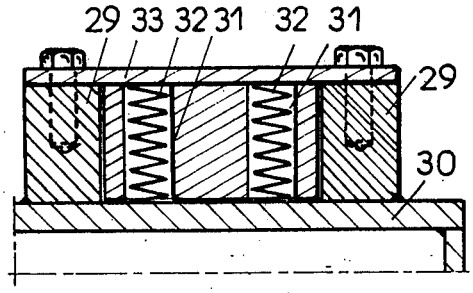
FIG. 12 is a section taken on line 12—12 in FIG. 11.

In particular, FIGS. 11 and 12 show a useful embodiment of such oscillating rollers comprising a support body 25 carrying a shaft or axle **25*a* on which the roller assembly 26 is mounted, said axle 25*a*** having an inclination of the order of 45° with respect to the support base of the body.

The support body 25 has a bore 27 engaged by an axle 28 carried by two lateral plates 29 rigidly cross connected at their base by a plate or fixation member 30.

The body 25 is provided with two bores 31 extending perpendicularly to the bore 27 and in back of the latter and a compression spring 32 is mounted in each bore 31 bearing, on the one hand, against the member 30 and, on the other hand, against a compression plate 33 fixed by screws to the upper face of the body 25.

The body 25 additionally has on its lower face a chamfer 34 extending beyond the axis of the bore 27. It is contemplated that the assembly 26 and the carrier body 25 can pivot around shaft 28 against the opposing action of the springs 32.

The rollers, thus constituted, can be fixed, by imbedding and welding by means of member 30 and by reinforcements at the rear and front faces of the posts 1 and 11 of the masts. The rollers permit:

determination of the limitation of play between the fixed and movable posts of the masts;

obtention of a constant bearing of the rollers on their rolling paths such that they turn immediately and constantly at the time of movement of the mast;

avoidance of all contact and friction between the fixed and movable portions of the mast thus substantially eliminating all risk of wear of said portions;

neutralization of torsional moments in all directions which could be applied to the fixed and movable portions of the mast in the course of travel;

reduction of the forces necessary to obtain the movements of the movable portions of the machine, the movable slide sliding easily and perfectly in all positions it can take in the inclined positions generally adopted for mining research.

The rotation head 16 of the machine, conventionally constituted by a hydraulic motor constructed in known manner, is slidably mounted on the beams 11.

In this regard, the head 16 is carried laterally by slidable supports 17 assuring its guidance on beams 11. These slidable supports are advantageously provided with rollers **17*a* schematically represented in FIGS. 3 and 5 and the position of which is shown by the dotted axis in FIG. 9. These rollers roll, for example, on the internal faces of beams 11 and facilitate the displacement of the rotation head along the entire length of the beams 11.**

Figures 4, 7:
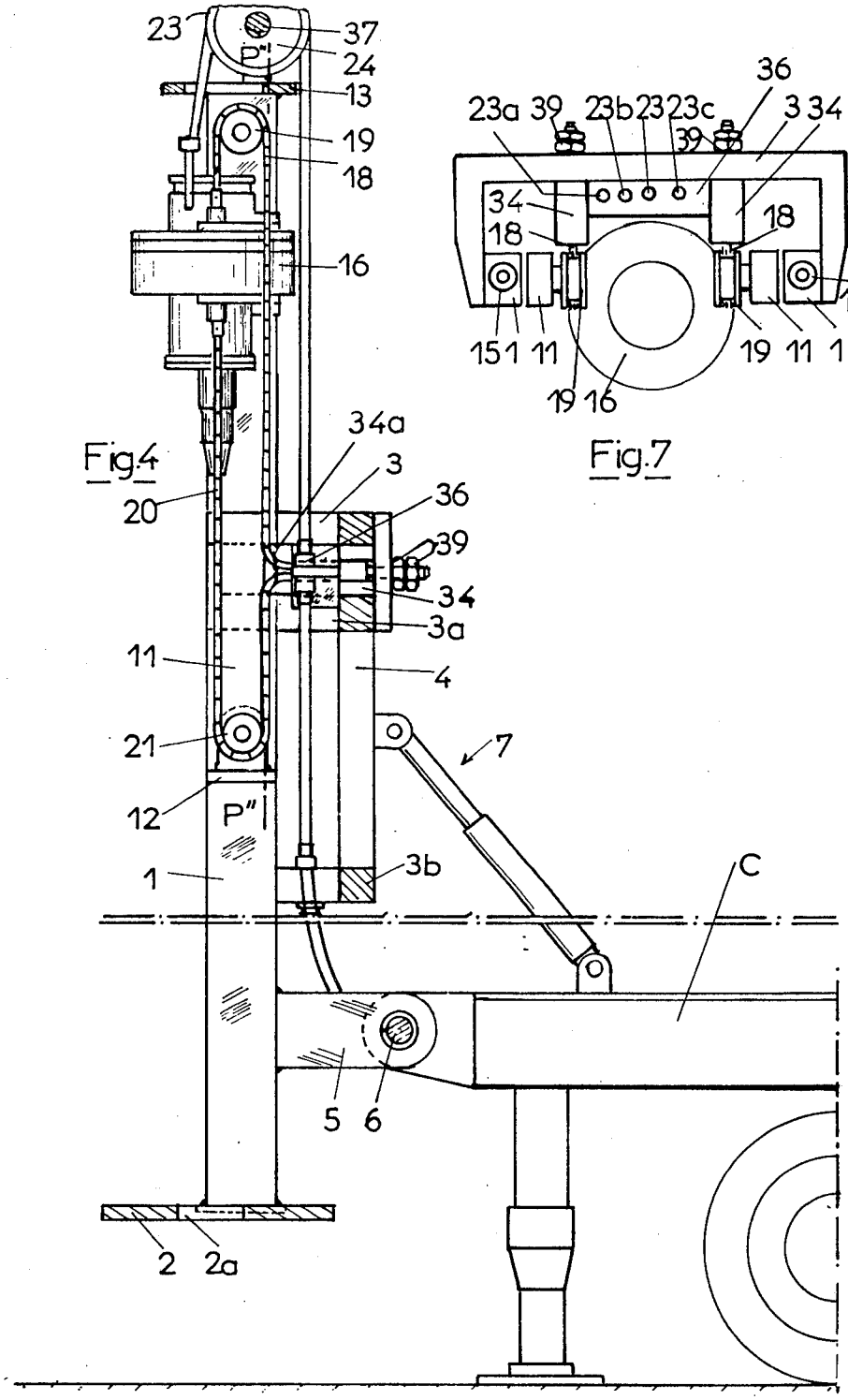
FIG. 4 is a sectional view taken along line 4—4 in FIG. 3.
FIG. 7 is a sectional view taken on line 7—7 of FIG. 5.
Figure 5:
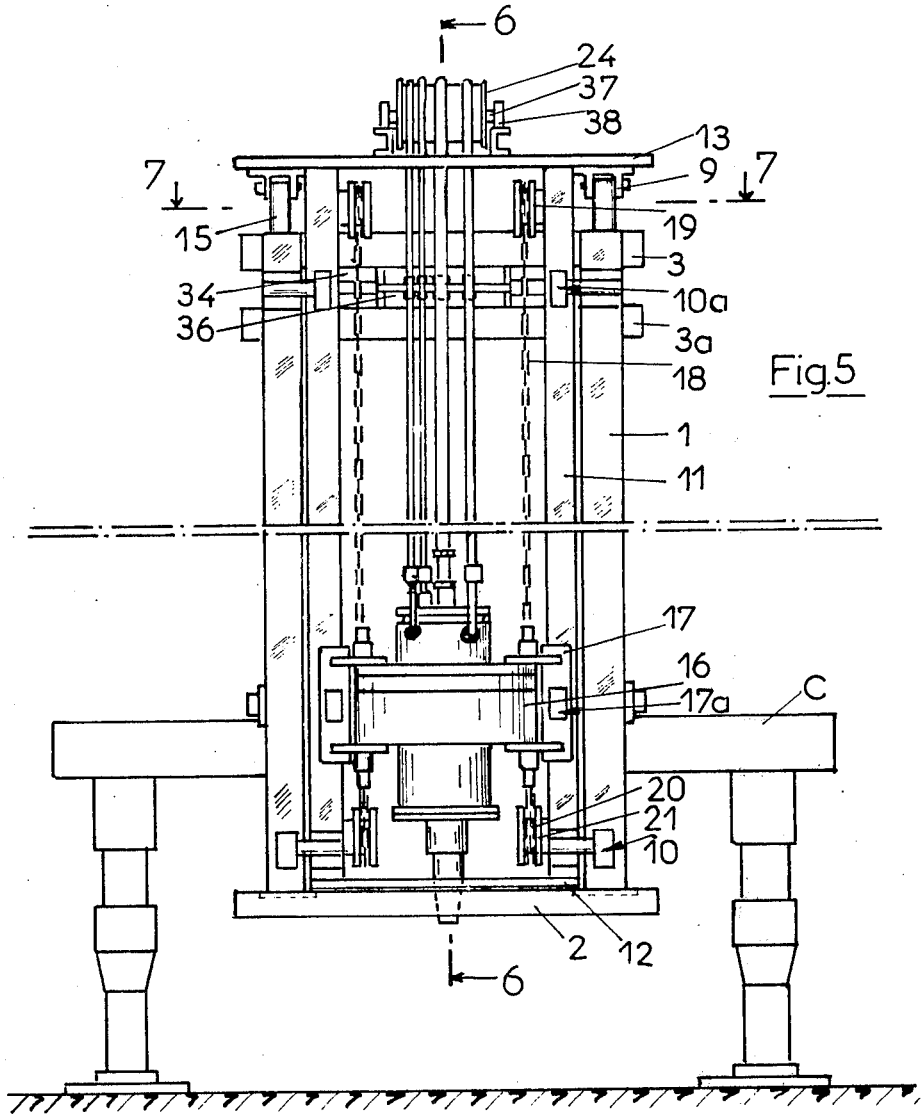
FIG. 5 is a front view on greater scale corresponding to FIG. 2.

The drilling apparatus further comprises means for synchronizing the movements of the raising of the upper portion of the mast with the raising of the rotation head along the length of the upper portion and reversely the movements of lowering the upper portion with descent of the rotation head. In this way, the rotation head is found at the base of the mast when the upper movable portion is completely retracted (FIGS. 2, 5 and 6), whereas it reaches the summit of the mast when the upper movable portion is in maximum position of extension (FIGS. 1, 3 and 4).

The means for synchronization which participates with the mounting of the jacks 15 further comprises:

a first pair of chains 18 or other flexible lines, each of which is wound on a wheel or similar rotatable member 19 mounted for free rotation at the upper extremity of each of the beams 11, one of the extremities of the chain 18 being fixed to the slidable support 17 or to the gearcase of the rotation head 16 and the other extremity to the cross braces 3–3*a* rigidly connecting the upper extremity of the fixed posts 1;

a second pair of chains 20 or other flexible lines, each of which is wound on a wheel or similar rotatable member 21 mounted for free rotation at the lower extremity of each of the beams 11, one of the extremities of the chain being fixed to slidable support 17 or to the gear case of the rotation head 16 and the other extremity to the upper cross braces 3–3*a*. The wheels 19 and 21 are identical and are mounted on the internal face of the beams 11.

It is to be understood that the extension of the movable portion of the mast produces an ascending movement in translation of the head 16 over the length of the movable portion through the intermediary of the chains 18 from which the head 16 is suspended. Reversely, the lowering of the upper portion of the mast produces descent of the rotation head 16 through the chains 20.

It is also arranged that the displacements of the rotation head is effected at a speed which is equal to two times that of the movements of the upper portion of the mast.

According to further characteristics of the invention, the axes of the jacks 15 and the axes of the wheels 19 and 21 are disposed in the same plane P—P (FIGS. 8 and 9) whereas the lengths of the chains 18 and 20 connecting the rotation head to the wheels 19 and 20 respectively is situated in the same plane P′–P′ as the longitudinal axis of the rotation head (FIGS. 4, 6 and 9).

These arrangements permit transmission to the movable portions of the machines and to the drill string compression and tensile forces perfectly rectilinear and parallel to the axis of the jacks 15 which generate the forces.

In fact, the resultant of the forces of compression and tension are found in the plane of the axes of the jacks. Since the attachment of the chains 18–20 is disposed along a tangent to the wheels 19 and 21 (planes P′—P′ – P″—P″) the resultant passes through the axes of the wheels.

In this manner, the movable members of the machine and the drill string are perfectly guided, not only during descent, but also during raising without which they would be subjected to pivoting forces. As a result of this, a perfect operation is obtained without any friction and therefore without wear of the fixed or movable parts of the machine. Furthermore, the drill string therefore remains perfectly guided in the rotation table 2 without risk of destruction of the means joining the elements of the string or elongation of the drill string.

According to another characteristic arrangement of the invention, the chains 18 and 20 are fixed to the upper cross braces 3—3*a* by means permitting adjustment of their tension.

In this respect, the extremity of each pair of chains 18, 20 is fixed in a double cap or fixation head 14 (FIG. 13) provided at the rear with a threaded stem 22. The cap 14 is mounted with slidable capability in a guide 34 fixed by welding or other means to the upper cross braces 3–3*a*, whereas the stem 22 traverses a bore provided in a plate 35 constituting the posterior wall of the guide 34. A nut arrangement 39 is threaded on the extremity of the threaded stem 22 and bears at its rear face against the plate 35 to permit an increase or reduction of the tension in the chains 18, 20 by adjustment of the position of the nuts 39 on stem 22.

To facilitate the bearing of the extremity of attachment of the chains, the guide 34 is provided at its inlet with curved faces 34*a* on which the chain extremity rests. The extremities of the curved faces 34*a* are disposed in the plane P″—P″ tangent to the wheels 19 and 21 such that the lengths of the chains 18, 20 are perfectly parallel.

The means for adjusting the tension of the chains provides for perfect alignment of the axis of the rotation head 16 of the drill string and of the guide stem (not shown) provided at the aperture 2*a* of the rotation table 2 and avoids general wear of the assembly and notably jamming at the time of manipulation of screwing or unscrewing of the shafts of the drill string which must present a rigorous alignment at the time of these operations in order to avoid a rapid deterioration of these essential and costly members.

The machine according to the invention further comprises an arrangement by which the flexible conduits connected to the rotation head cannot form suspended loops when the latter is displaced towards the bottom.

According to this arrangement, flexible conduits 23, 23*a*, 23*b*, 23*c* . . . connected to the rotation head and adapted, for example, for the feed of the hydraulic motor of this head, the return of hydraulic fluid, the feed of compressed air for the drilling tool through the drill string, the injection of water, etc . . . bear on a drum 24 at the top of the upper movable portion of the mast and each conduit comprises a section connected on the one hand to the rotation head and on the other hand to a conventional sealed coupling arrangement 36 rigidly fixed on the upper cross braces 3–3*a*.

Another section of the conduits connects the cross brace to a feed source (hydraulic pump, compressor, etc . . . ) disposed on the chassis of the vehicle.

It is understood that at the time of retraction movements of the upper portion of the mast, the rotation head descends on the upper portion by an amount equal to the descending movement of the upper portion while carrying along the flexible conduits which slide on the drum 24 at the summit of the mast. The length of the piece of each section of conduit between the fixed coupling arrangement 36 and the summit of the mast decreases, whereas the section connecting the summit to the rotation head increases, the total length, of course, remaining constant.

The movements of raising the upper portion of the mast produce the reverse result.

The sections of conduits connected to the rotation head are always perfectly secured and do not form any loops whatever the position of the movable elements (upper slide and rotation head) of the machine. Therefore, they are permanently placed in the best conditions of operation.

The sections of conduits connected to the rotation head bear on the drum 24 which is mounted for free rotation on shaft 37 carried by flanges 38 fixed to the upper surface of plate 13 serving for upper cross bracing for the posts 11 of the movable slide.

Due to this arrangement, the drive or rotation head 16 can occupy in the state of maximum extension of the mast, a position very close to the plate 13 and thus have an operative course of travel of maximum amplitude from one extremity to the other of the mast. Furthermore, the flanges 38 supporting the shaft 37 can be provided with any known means permitting adjustment of the position of shaft 37 in the longitudinal plane of the mast in a manner to take up any elongation or stretching of the sections of flexible conduits which is frequently produced after a certain period of time. It is thus possible to avoid premature deterioration of these conduits.

We have not described nor shown in order not to improperly burden the present disclosure and the annexed drawings, certain arrangements which conventionally complete the drillingor boring apparatus such as the aspirator for the decoupling of the lengths or bars of the drill string, these arrangements being well known in and of themselves.

In the same spirit, we have not deemed it necessary to describe and illustrate the fluid pressure sources on the chassis of the vehicle and necessary for the operation of the jacks, the rotation head and the drilling tool, nor the different control means for these members which are realized in conventional manner.

The description which has been preceded and the annexed drawings have underlined the advantages provided by the apparatus of the invention.

The compactness and the robustness of the mast, the power which can be developed by the jacks without risk of buckling, the perfect guidance of the movable members and the judicious distribution of the forces producing their movements, permit the production of powerful forces capable of effecting drilling of relatively substantial diameter to great depths exceeding one thousand meters at high pressure.

In addition, the relative lightness of the mast allows its adaptation on lightweight all-purpose vehicles of reduced size.

What is claimed is:

1. Drilling apparatus comprising an extensible mast including a fixed lower ramp including a pair of posts with cross-bracing means, an upper movable slide slidably mounted on said lower ramp between retracted and extended positions, said movable slide including a pair of posts with cross-bracing means, a rotation head slidably mounted on said upper slide for movement along the length of said slide, means for synchronizing movements of extension and retraction of the slide with respective ascending and descending displacement of the rotation head, the synchronizing means comprising two double-acting jacks connecting the lower portion of the fixed ramp to the upper portion of the movable slide, a first pair of chains, a pulley mounted on the upper extremity of each of the posts of the movable slide and having a respective chain wound thereon, each chain having one end fixed to the rotation head and an opposite end fixed to the cross-bracing means connecting the posts of the fixed ramp, a second pair of chains, a second pulley mounted at the lower extremity of each of the posts of said movable slide and having a respective chain of said second pair wound thereon, each of the second chains being fixed at one end to the rotation head and at the other end to the cross-bracing means connecting the posts of the fixed ramp, said jacks having axes of extension and retraction, said pulleys having axes of rotation, said axes of said jacks and said pulleys being disposed in a common plane.

2. Drilling apparatus as claimed in claim 1, wherein said rotation head has a longitudinal axis for rotation of a drill string, said chains having lengths extending from the rotation head to the associated pulleys disposed in the same plane as the longitudinal axis of the rotation head, said plane being tangent to the said pulleys.

3. Drilling apparatus as claimed in claim 1, wherein said posts of the fixed ramps are hollow and said double acting jacks are coaxially disposed within said posts, said jacks having upper ends connected to the movable slide.

4. Drilling apparatus as claimed in claim 3, comprising a table secured to the posts of the fixed lower ramp and having an aperture for passage of a drill string, said double-acting jacks being secured to said table.

5. Drilling apparatus as claimed in claim 1, comprising means for adjusting the tension in the chains.

6. Drilling apparatus as claimed in claim 5, wherein said means for adjusting the tension in the chains comprises a support for both pairs of chains, said support being slidably mounted in the cross-bracing means for the posts of the fixed ramp, a threaded stem extending from said support, nut means threaded on said stem and engaging said cross-bracing means for the posts of the fixed ramp for adjusting the position of the support in such cross-bracing means thereby to adjust the tension in the chains.

7. Drilling apparatus as claimed in claim 6, comprising guide means secured to the cross-bracing means of the fixed ramp and slidably receiving said support for the chains, said guide means having an inlet for the chains with curved surfaces on which the chains are disposed, said curved surfaces being disposed in a plane tangent to said pulleys.

8. Drilling apparatus comprising an extensible mast including a fixed lower ramp, including a pair of posts with cross-bracing means, an upper movable slide slidably mounted on said lower ramp between retracted and extended positions, said movable slide including a pair of posts with cross-bracing means, a rotation head slidably mounted on said upper slide for movement along the length of said slide, means for synchronizing movements of extension and retraction of the slide with respective ascending and descending displacement of the rotation head, the synchronizing means comprising two double-acting jacks connecting the lower portion of the fixed ramp to the upper portion of the movable slide, a first pair of chains, a pulley mounted on the upper extremity of each of the posts of the movable slide, each chain having one end fixed to the rotation head and an opposite end fixed to the cross-bracing means connecting the posts of the fixed ramp, a second pair of chains, a second pulley mounted at the lower extremity of each of the posts of said movable slide, each of the second chains being fixed at one end to the rotation head and at the other end to the cross-bracing means connecting the posts of the fixed ramp, and roller means guiding the movement of the upper slide on the fixed ramp during retraction and extension, said roller means including first rollers mounted on the movable slide at the lower extremity thereof and in rolling contact with the fixed ramp and second rollers mounted on the fixed ramp at the upper extremity thereof and in rolling contact with the movable slide, and means supporting the first and second rollers respectively from the movable slide and fixed ramp for pivotable movement.

9. Drilling apparatus as claimed in claim 8, wherein said first and second rollers roll on internal edges of the posts of the fixed ramp and on external edges of the posts of the movable ramp, said rollers each being provided with a groove having a complementary profile to that of said edges.

10. Drilling apparatus as claimed in claim 8 wherein the means supporting the rollers for pivotable movement comprises a carrier body rotatably supporting the associated roller, a fixed shaft secured to the associated mast member and pivotally supporting the carrier body, and spring means acting between said carrier body and the associated mast member to resiliently urge the associated roller into contact with the respective edge of the post.

11. Drilling apparatus as claimed in claim 10 wherein said carrier body has a blind bore, said spring means being engaged in said blind bore and bearing at one end on said associated mast member and at the other end on said carrier body, said bore and spring means being offset from said fixed shaft.

12. Drilling apparatus as claimed in claim 8 comprising slidable support means on said rotation head supporting the rotation head for slidable movement on the upper slide, said slidable support means including rollers in rolling contact with edges of the posts of the upper slide, said rollers having grooves with a complementary profile to that of said edges.

13. Drilling apparatus comprising an extensible mast including a fixed lower ramp including a pair of posts with cross-bracing means, an upper movable slide slidably mounted on said lower ramp between retracted and extended positions, said movable slide including a pair of posts with cross-bracing means, a rotation head slidably mounted on said upper slide for movement along the length of said slide, means for synchronizing movements of extension and retraction of the slide with respective ascending and descending displacement of the rotation head, the synchronizing means comprising two double-acting jacks connecting the lower portion of the fixed ramp to the upper portion of the movable slide, a first pair of chains, a pulley mounted on the upper extremity of each of the posts of the movable slide, each chain having one end fixed to the rotation head and an opposite end fixed to the cross-bracing means connecting the posts of the fixed ramp, a second pair of chains, a second pulley mounted at the lower extremity of each of the posts of said movable slide, each of the second chains being fixed at one end to the rotation head and at the other end to the cross-bracing means connecting the posts of the fixed ramp, flexible conduits connected to said rotation head for supply of pressure fluid thereto, and means for connecting said flexible conduits to said rotation head and to said mast including a fixed coupling secured to the cross-bracing means for the posts of the lower ramp, said conduits each including a section connected at one end thereof to said fixed coupling in sealed relation and at its opposite end thereof to said rotation head, and support means on said movable slide on which said conduits are wound.

14. Drilling apparatus as claimed in claim 13 wherein said support means for the conduits is rotatably mounted on the movable slide.

15. Drilling apparatus as claimed in claim 14 wherein said support means comprises a drum and a shaft rotatably supporting the drum from the movable slide.

16. Drilling apparatus as claimed in claim 15 wherein said support means further comprises means for adjusting the position of the shaft for the drum with respect to the movable slide to take up stretching of the section of the conduit.

* * * * *